US005350062A

United States Patent [19]

Takiguchi et al.

[11] Patent Number: 5,350,062

[45] Date of Patent: Sep. 27, 1994

[54] WRAPPER OF FILM UNIT WITH LENS

[75] Inventors: Miho Takiguchi; Noriko Katayama; Aya Itoh; Kaori Ohama, all of Tokyo; Yasuo Tanaka, Oosaka, all of Japan

[73] Assignee: Fuji Photo Film Co., Ltd., Kanagawa, Japan

[21] Appl. No.: 96,824

[22] Filed: Jul. 26, 1993

Related U.S. Application Data

[62] Division of Ser. No. 977,202, Nov. 16, 1992, abandoned.

[30] Foreign Application Priority Data

Nov. 18, 1991 [JP] Japan ..... 3-094428[U]

[51] Int. Cl.[5] ..... B65D 85/38

[52] U.S. Cl. ..... 206/316.2; 206/316.1; 229/207; 229/242

[58] Field of Search ..... 206/316.1, 316.2, 578; 229/207, 242; 383/210, 211

[56] References Cited

U.S. PATENT DOCUMENTS

| | | | |
|---|---|---|---|
| 3,731,586 | 5/1973 | Meazza | 206/316.2 |
| 4,158,412 | 6/1979 | Wysocki | 229/207 |
| 4,738,365 | 4/1988 | Prater | 229/207 |
| 5,078,273 | 1/1992 | Kuchenbecker | 229/207 |

FOREIGN PATENT DOCUMENTS

| | | | |
|---|---|---|---|
| 2061691 | 6/1972 | Fed. Rep. of Germany | 206/316.2 |
| 2338945 | 2/1975 | Fed. Rep. of Germany | 206/316.2 |
| 2513597 | 4/1983 | France | 206/316.1 |
| 63-6436 | 1/1988 | Japan . | |
| 64-544 | 1/1989 | Japan . | |
| 3-54935 | 5/1991 | Japan . | |
| 3-56930 | 5/1991 | Japan . | |
| 3-56931 | 5/1991 | Japan . | |

*Primary Examiner*—David T. Fidei

*Attorney, Agent, or Firm*—Young & Thompson

[57] ABSTRACT

In the present invention, a portion of the outer surface of a wrapper of film unit with lens is previously constructed in a manner capable of being peeled therefrom. When the portion of the surface is removed, such as a photographic objective and a finder of the film unit with lens are exposed. Thus, photographing is possible in the state where the film unit with lens is covered with the wrapper, thereby the wrapping is efficiently used. In the present invention, peeling portion capable of being peeled may also be provided continuously through the front surface, the upper surface and the rear surface of the wrapper. When such peeling portion is peeled, the front surface of the peeling portion may be bent from the wrapper at a folding line, whereby a projecting piece may be inserted into between the peeling surface and a plane at the rear surface thereof. Thus, the peeling portion is not separated at the time of photographing and, after photographing, it may be easily pasted to its original state to be used as a protection cover thereof if an unexposed film still remains.

11 Claims, 9 Drawing Sheets

WRAPPER OF FILM UNIT WITH LENS

BACKGROUND OF THE INVENTION

1. Field of the Invention

The present invention relates to a wrapper of film unit with lens.

2. Description of the Related Art

In conventional photographing, a film is to be charged into a camera. There has been an inconvenience, however, that there may be no camera at hand, since only a few people carry a camera at all times with them. In such case, it is greatly convenient if a film unit with lens is available at a nearby store at a low price comparable to buying a conventional photographing film and if, after photographing, an order for DPE can be made in the form of a film unit with lens in a similar manner as in the case of a conventional photographing film.

In prior art, such a film unit with lens is covered with an outer case made of paper over the main portion of the film unit surface thereof and it is furthermore wrapped by an aluminum moistureproof bag. Since such a wrapping bag is to be discarded after taking out the film unit with lens, it is a cause of a problem for example from the viewpoint of saving resources.

On the other hand, Japanese Utility Model Laid-Open Publication No. 3-56931 discloses a concept of forming the outer box of a film unit with lens by a removable/reattachable cover and a portion covering the unit at all times. Such a box, however, does not provide a moistureproof covering.

SUMMARY OF THE INVENTION

The present invention has been made in view of the above-mentioned facts and it aims at providing a wrapper of film unit with lens of which the wrapping may be efficiently used.

In order to achieve the above object, according to the present invention, there is provided a wrapper for covering a film unit with lens previously containing an unexposed film within a light-shielding container thereof and adapted to take a photograph of an object on the unexposed film by exposing the unexposed film through a photographic objective provided on the light-shielding container, where the wrapper is characterized in that a portion of the surface thereof is previously formed in a manner capable of being peeled so that, when the portion of the surface of the wrapper is peeled, at least the photographic objective and the external operation members of the film unit with lens are exposed whereby photographing is possible in the state where the film unit with lens is covered with the remaining portion of the wrapper.

According to the present invention, since such as the photographic objective and the external operation members are exposed when a portion of the surface of the wrapper is removed, the film unit with lens may be operated for photographing in the state where it is covered with the wrapper whereby most of the wrapping may be efficiently used.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DESCRIPTION OF THE PREFERRED EMBODIMENTS

Detailed description will hereunder be given of the preferred embodiments of a wrapper of film unit with lens according to the present invention with reference to the accompanying drawings.

Figure 1:
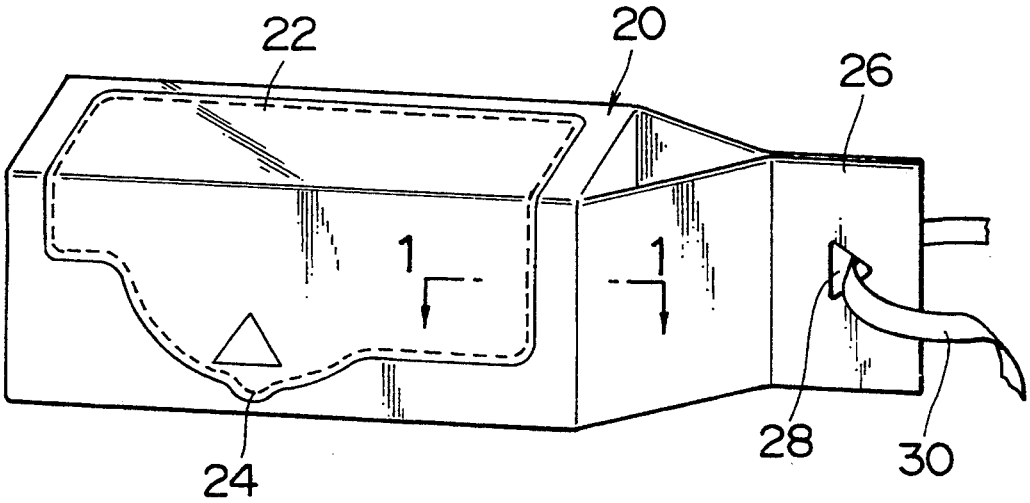
FIG. 1 is a perspective view showing an embodiment of a wrapper of film unit with lens according to the present invention.
Figure 2:
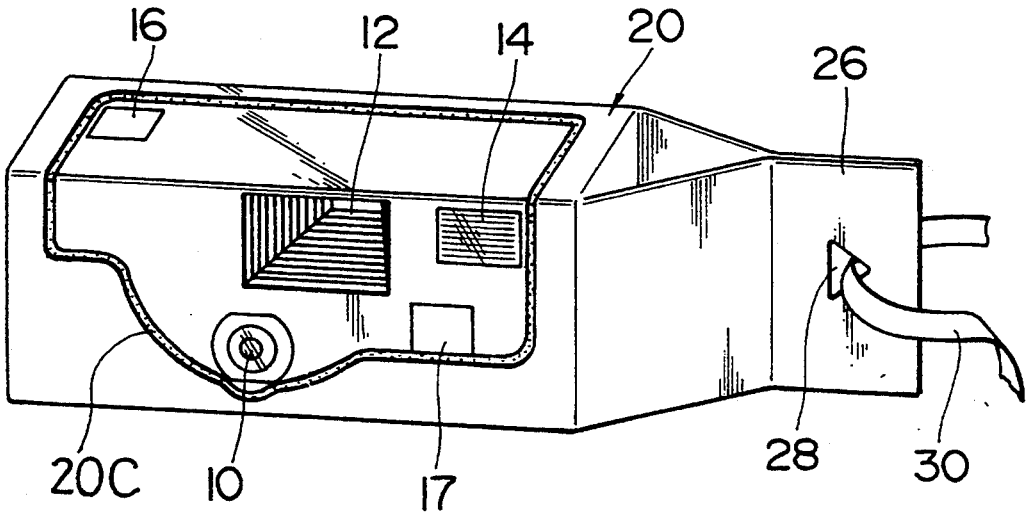
FIG. 2 is a perspective view of the wrapper of film unit with lens of FIG. 1 as shown in the state where a part of the external surface thereof is removed.

FIG. 1 is a perspective view showing an embodiment of a wrapper of film unit with lens according to the present invention; and FIG. 2 is a perspective view of the same where a portion of the external surface of the wrapper is removed to show a portion of the film unit with lens at the interior thereof.

This film unit with lens is constructed, for example, as disclosed in Japanese Patent Laid-Open Publication No. 64-544, such that a rear surface cover for shielding the film chamber from light is firmly fixed to the main body thereof so that changing of film by a general user is impossible unless a very difficult disassembling or a forced braking down is performed. It is thus constructed as a camera by which only a film previously charged thereto can be made to bear an image. It should be noted that the film unit in FIG. 2 includes: a photographic objective 10; a finder 12; a strobe emission window 14; a shutter release button 16; and a strobe switch 17.

The film unit with lens is inserted into a wrapper 20 under a predetermined temperature and humidity so as to be completely wrapped as shown in FIG. 1.

While the laminated structure of the wrapper 20 is not shown in detail, an aluminum foil is sandwiched by a base material formed of polyethylene and an ever film is formed on the inner side (toward the film unit with lens) of the base material. This ever film is used in thermal fusion bonding. Further, printing ink and polyester film are formed on the outer side of the base material via an anchor coat.

The wrapper 20 is provided with moistureproof and light-shielding functions by the aluminum foil. Further, since it has an ever film, its open end may be readily sealed by means of thermal fusion bonding.

The wrapper 20 is formed with a portion 22 which is previously formed in a manner removable therefrom. That is, the portion 22 of the external surface thereof is glued with a weak bonding force to the remaining portion of the wrapper and is constructed to be capable of being peeled therefrom. When it is not used after it is peeled off, it may be used as a cover again by adhering it in the original manner. A projecting piece 24 is formed on the portion 22 of the external surface so that the photographer is able to easily peel off the portion 22 of the external surface by pinching the projecting piece 24. The portion 22 of the external surface is formed as shown in FIG.2 into a shape covering the photographic objective 10, the finder 12, the strobe emission window 14, the shutter release button 16 and the strobe switch 17.

It should be noted that, though not shown in the figures, openings for a finder ocular and a film winding knob are provided on the rear surface of the wrapper 20. The openings are covered for example with a seal before their use, which may be readily peeled off to expose these members when they are to be used.

Further, a hole 28 is formed at a portion 26 on the free end of the wrapper 20 where bonding by means of thermal fusion is effected, the hole 28 being passed through by a strap 30. The hole 28 or the strap 30 may be used as a suspending hole or the like when sales display is made by suspending the unit from a hanger.

By the wrapper of the film unit with lens constructed as described according to the present invention, the film unit with lens in its market distribution process or at its sales stage at a shop is completely wrapped as shown in FIG. 1 in a moistureproof manner. On the other hand, when it is to be used, the portion 22 of the external surface thereof is peeled off as shown in FIG.2 to expose such as the photographic objective 10 so that photographing is possible in the state where the unit is covered with the wrapper 20.

Figure 3:
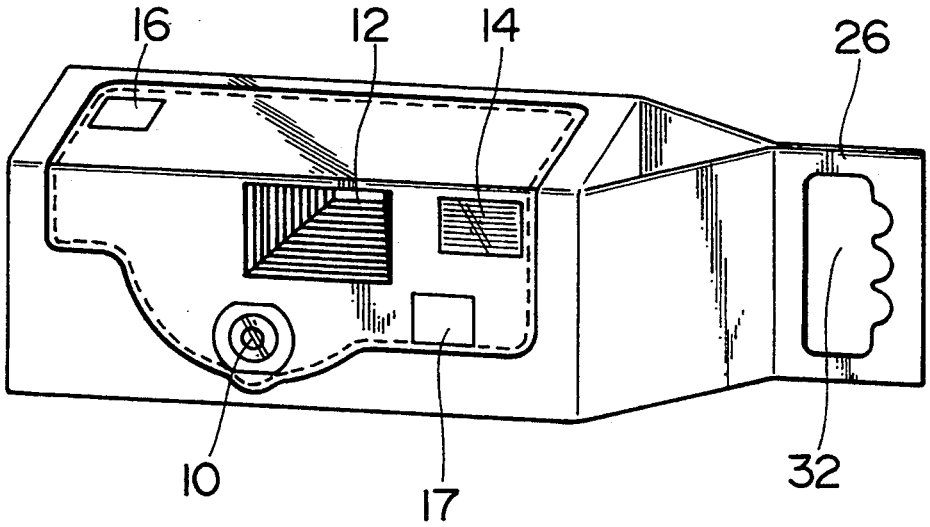
FIG. 3 is a perspective view showing another embodiment according to the present invention.

While the strap 30 is attached to the hole 28 of the wrapper 20 in the above-described embodiment, a relatively large hole 32 may be formed as shown in FIG. 3 instead of using the strap 30 so that the user's fingers can be inserted therein to facilitate its portability.

Figure 4:
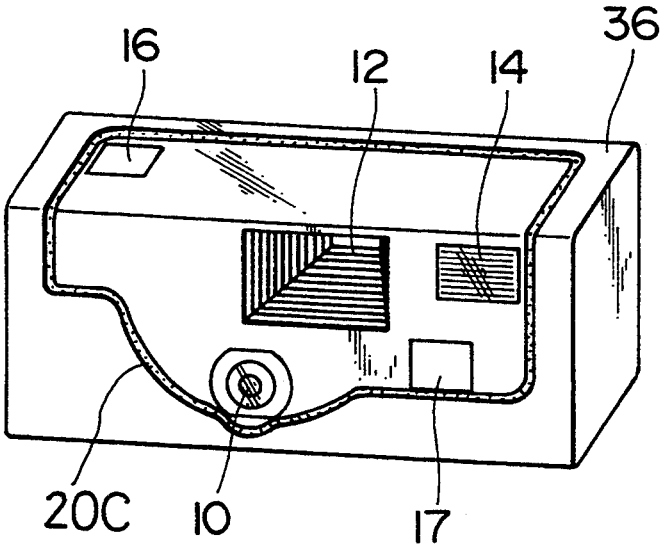
FIG. 4 is a perspective view showing another embodiment according to the present invention.

Further, while the extended portion 26 is formed on the wrapper 20 by bonding the open ends thereof by means of thermal fusion in the above described embodiment, the extended portion 26 may be eliminated to obtain a wrapper 36 having a complete box-shape as shown in FIG. 4 when it is thought that a suspending hole or a strap is unnecessary.

Figure 5:
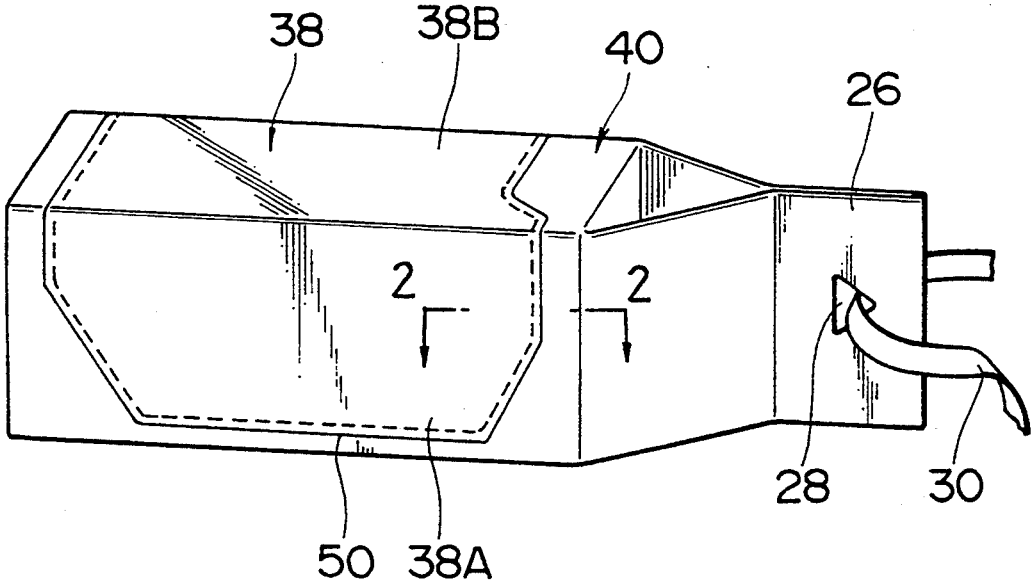
FIG. 5 is a perspective view showing another embodiment according to the present invention.
Figure 6:
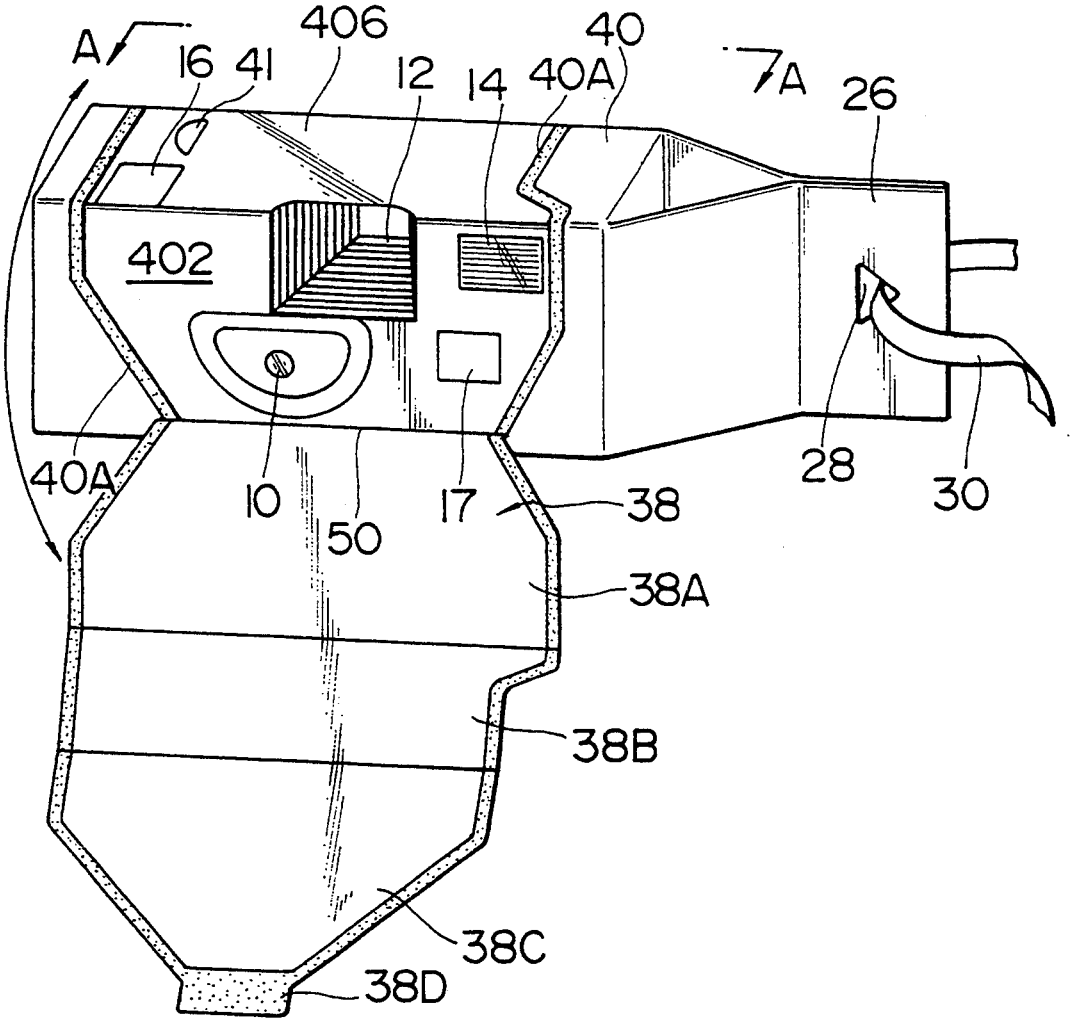
FIG. 6 is a perspective view of the embodiment of FIG. 5 in the state where photographing is possible.

Furthermore, while, in the above described embodiment, the removable portion 22 of the wrapper 20 is formed into such a shape that it may be peeled from the upper surface and the front surface of the wrapper 20, a peeling portion 38 may be provided in a removable manner continuously extending the front surface, the upper surface and the back surface of a wrapper 40 as shown in FIGS. 5 and 6.

Figure 12:
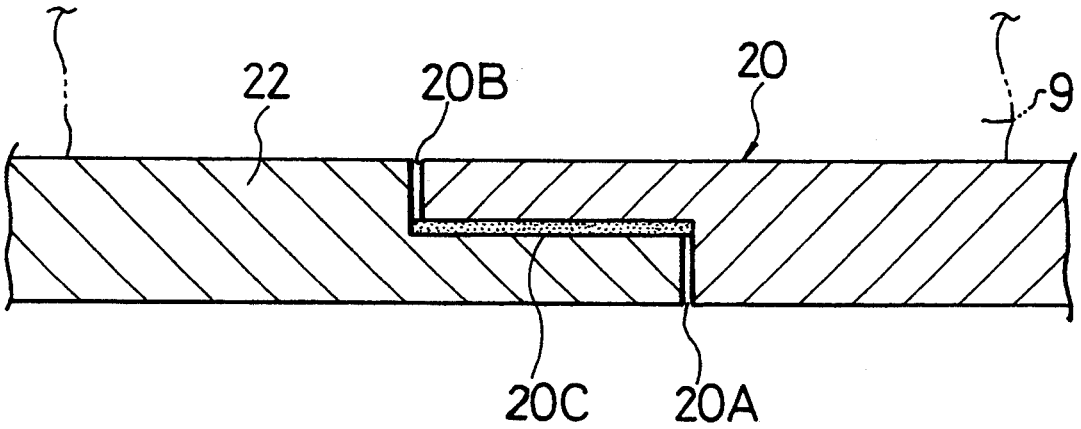
FIG. 12 is a sectional view taken along the line 1—1 in FIG. 1, i.e. a partial sectional view showing a structure of a connecting portion of a peeling portion.

The connecting portion of the peeling portion 22 as shown in FIG. 1 is illustrated in FIG. 12, the connecting portion between the peeling portion 22 and the remaining wrapper 20 is formed to provide a two-stage structure, and an outer boundary portion 20A and an inner (on the side of the film unit with lens 9) boundary portion 20B are shifted in position from each other and formed to provide a labyrinth structure. Thereby, the wrapper 20 is provided with waterproof and moistureproof effects. Incidentally, in FIG. 12, reference numeral 20C indicates a bonding agent layer which can be peeled off, and 9 a main body of the film unit with lens.

Figure 7:
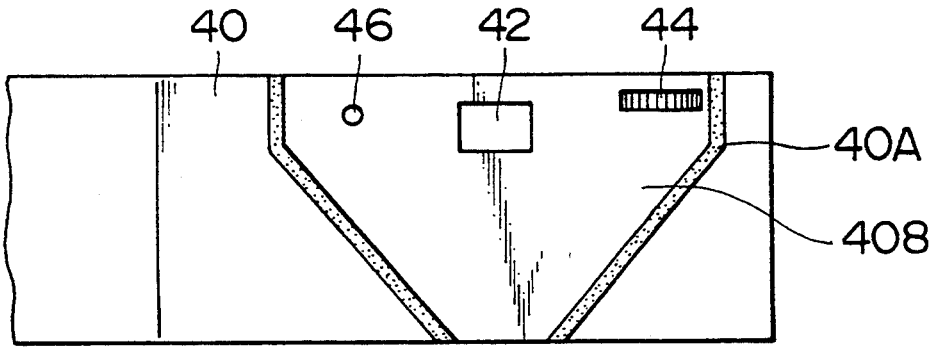
FIG. 7 is a view as seen along the arrows A—A of FIG. 6.

FIG. 5 is a perspective view of the wrapper 40 in such a case of film unit with lens which comprises another embodiment of the present invention; FIG. 6 is a perspective view showing the state where the peeling portion 38 is peeled from the state as shown in FIG. 5; and FIG. 7 is a rear side view of the film unit in the state where the peeling portion 38 is peeled. As shown in FIGS. 6 and 7, the front surface, the upper surface and the rear surface of the wrapper 40 have a partial opening thereon, respectively, and portions 38A, 38B, 38C of the peeling portion 38 are pasted to a pasting margin 40A formed on the respective openings in a manner capable of being peeled therefrom.

The front surface 38A of the peeling portion 38 is shaped in a similar manner as in the above described embodiment so that it covers the photographic objective 10, the finder 12, the strobe emission window 14, strobe switch 17 on the front surface of the film unit as shown in FIG. 6. The upper surface 38B of the peeling portion 38 is shaped such that it covers the release button 16 and a film counter 41 which are located on the upper surface of the film unit. Further, the rear surface 38C of the peeling portion 38 is shaped such that it covers a finder ocular portion 42, winding knob 44 and a strobe charge display light 46 on the rear surface of the film unit as shown in FIG. 7.

A pasting margin is formed on the edge on the reverse surface of the peeling portion 38. Further, a projection 38D is formed on the rear surface 38C and the projection 38D is pasted onto the bottom surface of the wrapper 40 in a manner capable of being peeled therefrom. Thus, the photographer is able to easily peel off the peeling portion 38 as the pasted portion is peeled when the projection D is peeled to open. It should be noted that such as a handling manual for the film unit with lens may be provided on the reverse surface of the peeling portion 38.

Figure 8:
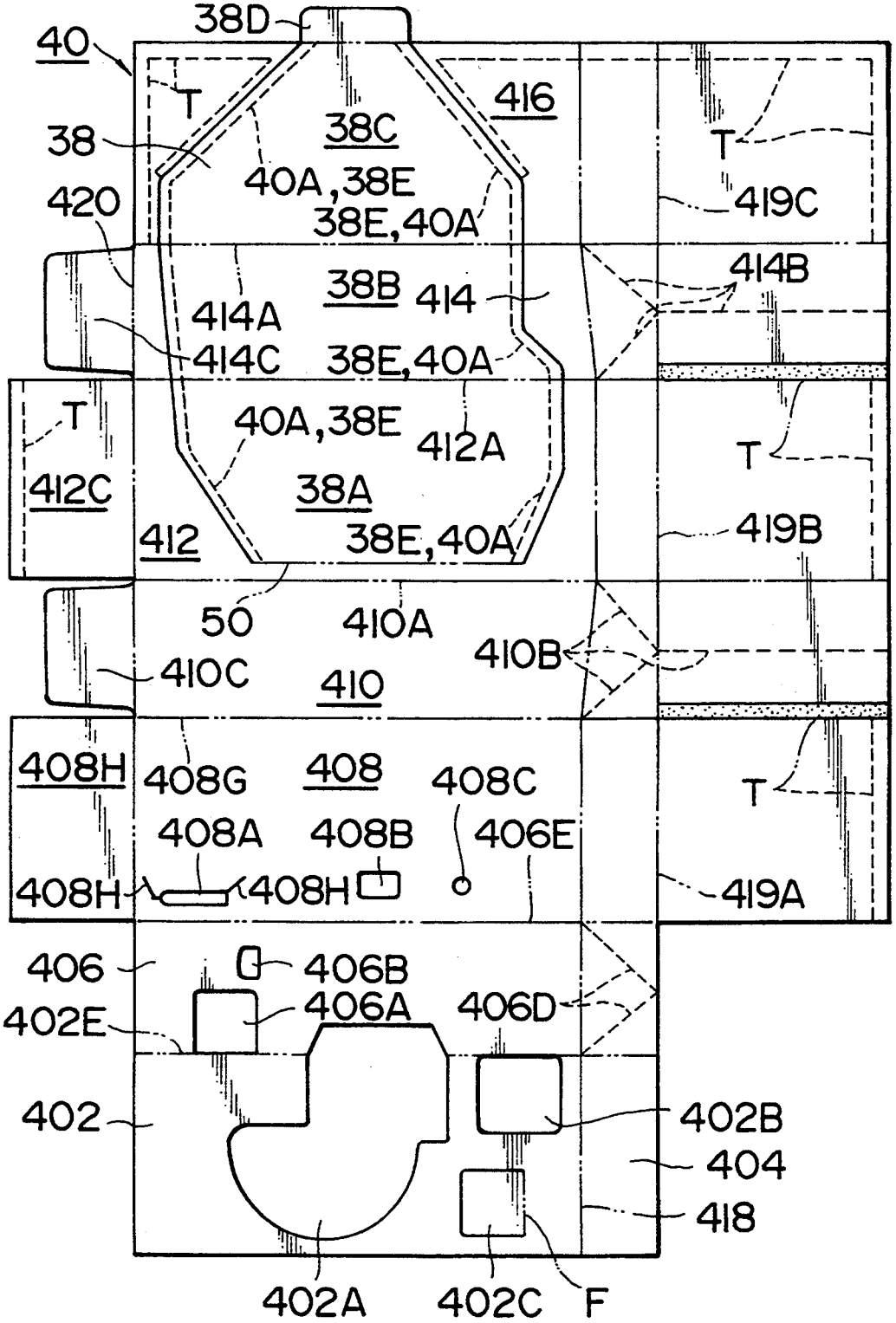
FIG. 8 is a development of another embodiment according to the present invention.

FIG. 8 is a top view of the state where the wrapper 40 is developed as seen from the front surface side thereof, the double-dashed chain lines showing the lines to be folded. In this figure, a plane 402 is positioned at the front surface of the film unit with lens, and the photographic objective 10 and the finder 12 as shown in FIG. 6 are positioned within an opening 402A thereof. The strobe emission window 14 is positioned within an opening 402B. A flap 402C is formed integrally at one side F thereof with the wrapper 40 in a manner bendable thereat and the other three sides thereof are detached from the wrapper 40. A strobe switch 17 is positioned at the flap 402C so that the strobe switch 17 is turned "ON" when the flap 402C is pressed.

A folding line 402E is folded outward so that a plane 406 is arranged over the upper surface of the film unit with lens, an opening 406A of the plane 406 being set to the position corresponding to the shutter release button 16. Further, an opening 406B thereof is set to the position corresponding to the film counter 41. Furthermore, line 406E is folded outward so that a plane 408 is positioned over the rear surface of the film unit with lens. Openings 408A, 408B of the plane 408 are set to the positions of the winding knob 44 and the finder ocular portion 42, respectively, an opening 408C being set to the position corresponding to the strobe charge display light 46. Since cut lines 408F, 408F are formed at the two end portions of the opening 408A, the plane 408 may be recessed along the concave portion around the winding knob 44 of the film unit with lens.

Furthermore, lines 408G, 410A, 412A and 414A of the wrapper 40 are folded outward to wrap the film unit with lens with the planes 410, 412, 414, 416. In this case, the plane portion 412 covers the plane portion 402 arranged on the front surface of the film unit with lens and the plane portion 416 covers the plane portion 408 arranged on the rear surface of the film unit with lens.

Further, line 418 extending in the longitudinal direction from the upper end portion of the wrapper 40 to the lower end portion thereof in FIG. 8 is folded outward and lines 406D, 410B and 414B formed on the right side of the line 418 are folded inward to form the extended portion 26 (see FIGS. 5 and 6) of the wrapper 40. In this case, folding lines 419A, 419B, 419C formed in parallel to the line 418 are folded inward. It should be noted that cut lines in the form of dashed lines are formed on folding lines 406D, 410B, 414B.

On the other hand, a folding line 420 extended in the longitudinal direction on the left end portion of the wrapper 40 is folded outward so that plane portions 408H, 410C, 412C, 414C respectively cover the right side surface of the film unit with lens in an overlapping manner. Thereby, the film unit with lens is contained in the wrapper 40. Then, portions indicated by T (see FIG. 8) having an adhesive applied thereon capable of thermal fusion bonding is bonded by means of thermal fusion to wrap the film unit with lens with the wrapper 40.

In addition, a peeling portion 38 is formed on the plane portions 412, 414, 416 which cover the outer surface of the plane portions 402, 406, 408 in an overlapping manner, pasting margin 38E being formed on the peripheral edge of the peeling portion 38. Further, pasting margin 40A is formed on the peripheral edge of the planes 412, 414, 416 of the wrapper corresponding to the peeling portion 38, the pasting margin 40A being integrally glued to the pasting margin 38E formed on the peripheral edge of the opening on the plane portions 412, 414, 416 in a manner capable of being peeled therefrom.

Figure 9:
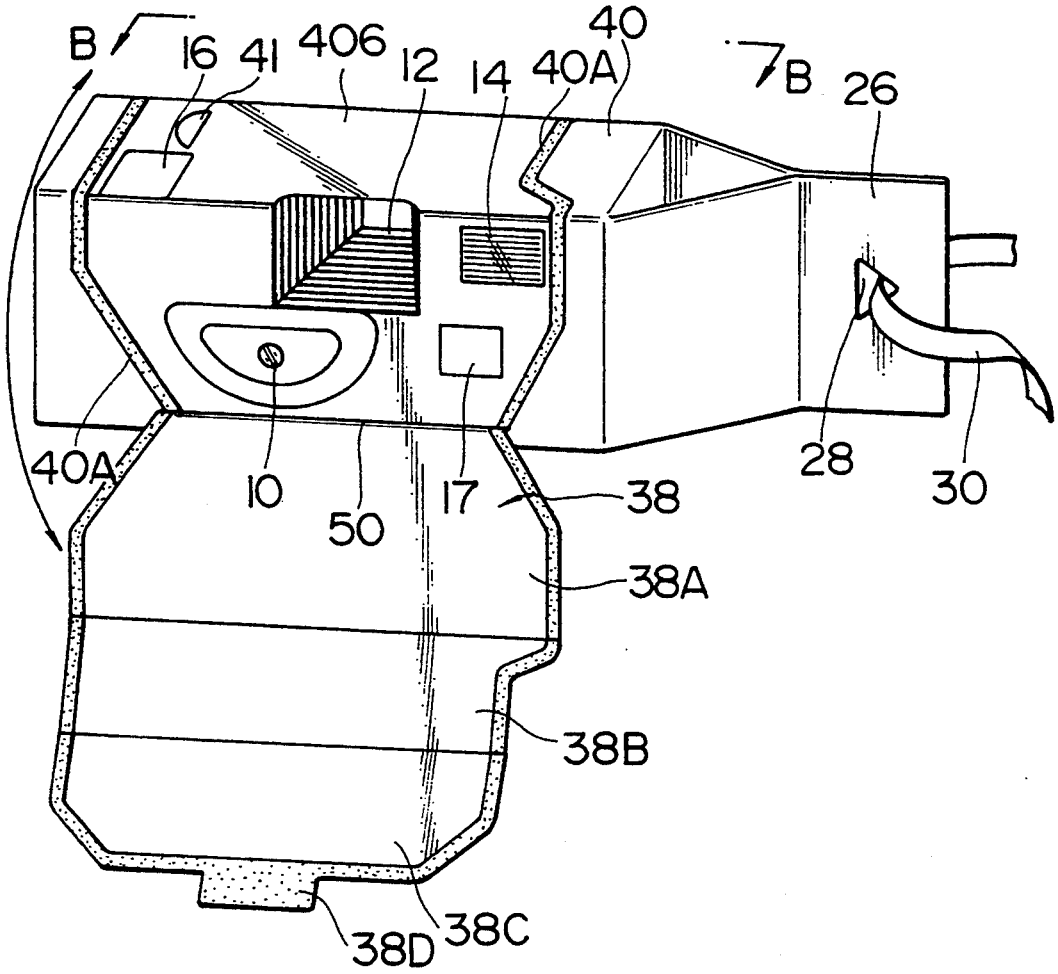
FIG. 9 is a perspective view showing another embodiment according to the present invention in the state where photographing is possible.
Figure 10:
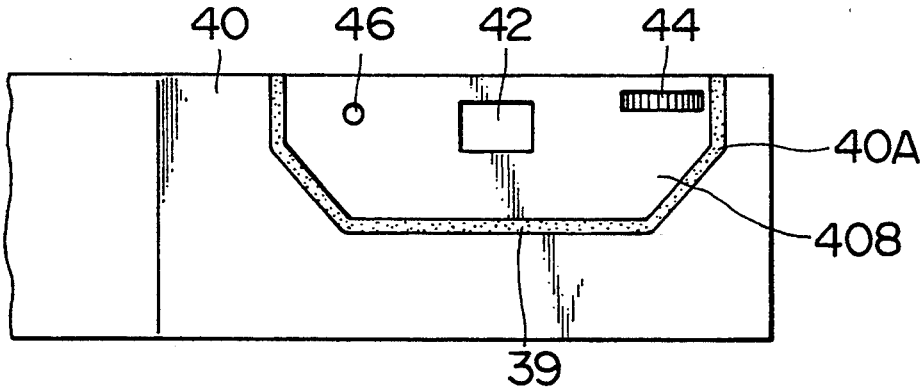
FIG. 10 is a view as seen along the arrows B—B of FIG. 9.
Figure 11:
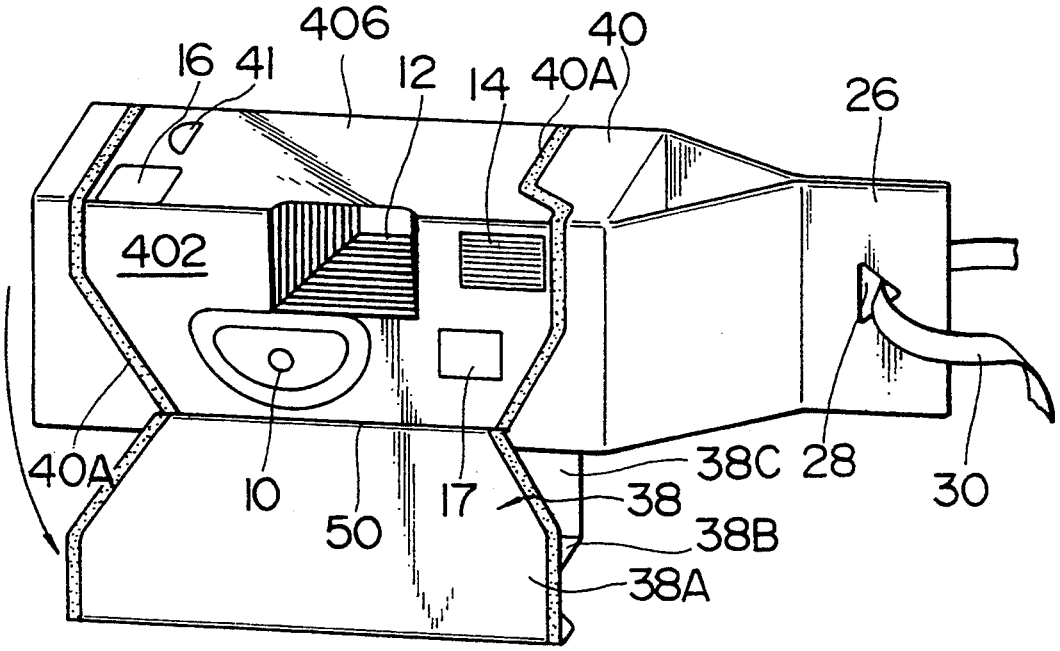
FIG. 11 is a perspective view showing the state where a projecting piece is folded into the back surface side from the state of FIG. 9.

In FIGS. 5 to 8, the shape of the rear surface 38C of the peeling portion 38 is formed such that it wraps the film unit with lens from the upper edge to the lower edge of the rear surface thereof. However, the present invention is not limited to this and the rear surface 38C of the peeling portion 38 may be shaped as shown in FIGS. 9 and 10 such that a peeling surface 39 is formed to wrap the rear surface of the film unit with lens to about the middle position between the upper edge and the lower edge thereof. In order to peel off the peeling portion 38, a projection 38D is first peeled off and the rear surface 38C, upper surface 38B, front surface 38A of the peeling portion 38 are then peeled off in that order. Here, if the front surface 38A of the peeled off portion 38 is folded toward the lower surface of the film unit with lens along a folding line 50, the projection 38D may be folded to be inserted into between the peeling surface 39 and the plane 408 as shown in FIG. 10. Thereby, the peeling portion 38 is folded as shown in FIG. 11. Thus, as shown in FIGS. 6 and 9, when the outer case is constructed as a double layer structure, the peeling portion 38 is not separated at the time of photographing, and, after the photographing, it may be easily pasted to its original state to be used as a protecting cover if unexposed film remains inside thereof.

Figure 13:
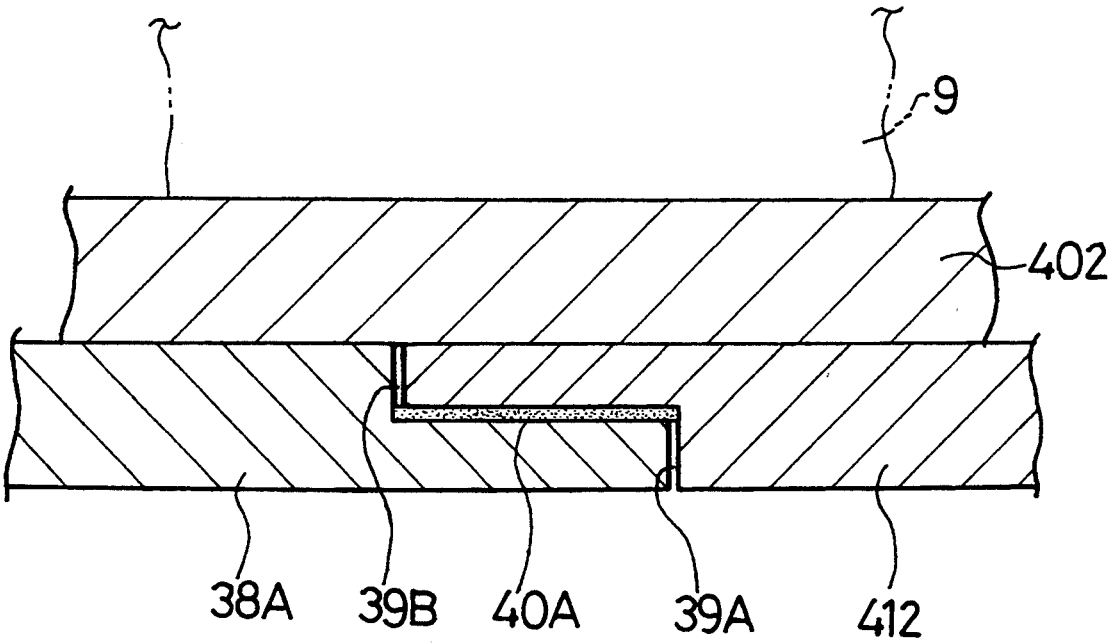
FIG. 13 is a sectional view taken along the line 2—2 in FIG. 5, i.e. a partial sectional view showing a structure of a connecting of a peeling portion.

The wrapper shown in FIGS. 1 through 4 is formed to provide a single layer structure and a labylinth structure shown in FIG. 12 is applied to the connecting portion of the peeling portion to thereby improve waterproof and moistureproof effects. The labyrinth structure is applicable also to the double layer structure shown in FIGS. 5 through 11 as shown in FIG. 13. That is, in FIG. 13, the wrapper is formed to provide the double layer structure including 402 and 412, the connecting portion between the peeling portion 38A and the remaining portion 412 is formed to provide a two-stage structure, and an outer boundary portion 39A and an inner (on the side of the film unit with lens 9) boundary portion 39B are shifted in position from each other and formed to provide a labyrinth structure. Thereby, the wrapper is provided with waterproof and moistureproof effects. Incidentally, in FIG. 13, numeral 40A indicates a bonding agent layer which can be peeled off and 9 a main body of the film unit with lens.

It should be noted that a laminate of paper and polyethylene or aluminum foil may also be used as the material for the wrapper where printing may be effected on the paper thereof.

As has been described above, the wrapper of the film unit with lens according to the present invention serves a function as a moistureproof bag having a moistureproof function through its distribution and selling. Further, after it is purchased, the film unit with lens is mostly covered with the wrapper even when a portion of the surface thereof is removed except that the portion necessary for photographing is exposed. Thus, both protection and ornament of the film unit with lens may be provided.

Furthermore, if connected to the wrapper at the portion represented by numeral 50, the removed surface portion of the present invention may be reused as a protection cover of the operation and optical portions such as the photographic objective by pasting it again to its original position.

Figure 14:
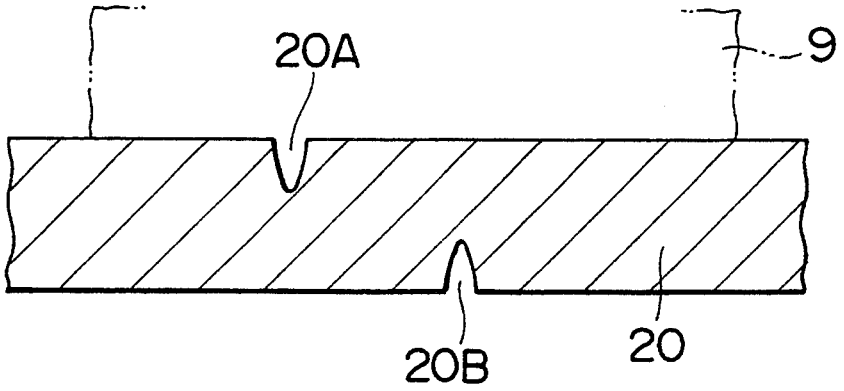
FIG. 14 is an enlarged view showing the state of the peeling portion before the wrapper having a single layer structure is cut off.
Figure 15:
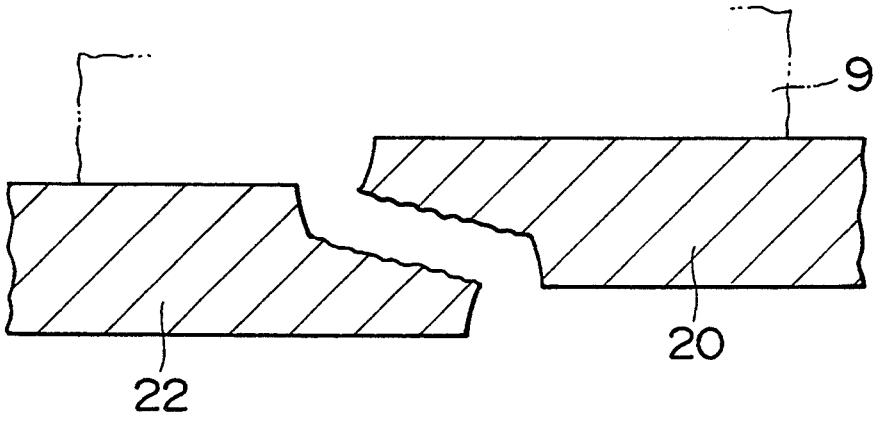
FIG. 15 is an enlarged view showing the state of the peeling portion after the wrapper shown in FIG. 14 is cut off.

FIGS. 14 and 15 show another embodiment of the wrapper 20 having the single layer structure, which is formed of a slightly thick paper. In the connecting portion of the wrapper as shown in FIG. 14, only the cut-in 20A from the inside and the cut-in 20B from the outside are formed, and no bonding agent is used. In order to peel the peeling portion 22 off the wrapper 20, when a finger nail or the like is inserted into the cut-in 20B from the outside and turns over the cut-in 20B outwardly, the paper is broken off along the tissue of the paper from the cut-in 20B to the cut-in 20A, whereby the peeling portion 22 is removed from the remaining portion of the wrapper 20 as shown in FIG. 15. In the wrapper shown in FIGS. 14 and 15, by forming only the cut-ins 20A and 20B, a cut-off portion of the peeling portion 22 having the waterproof and moistureproof effects can be formed, so that the manufacture can be easy.

Figure 16:
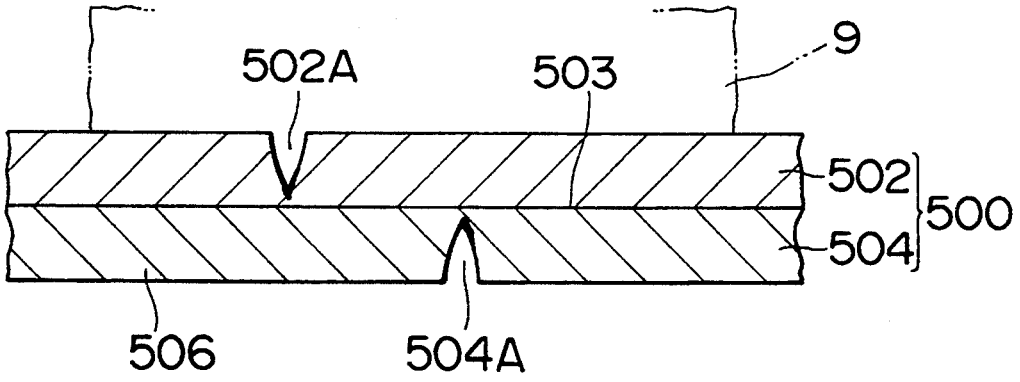
FIG. 16 is an enlarged view showing the peeling portion of the wrapper having a double layer structure.

FIG. 16 shows a wrapper 500 having a double layer structure. In this wrapper 500, an inner layer 502 and an outer layer 504 are previously connected to each other through a dry laminate layer 503 for connecting the layers to each other. The inner layer 502 is formed with a cut-in 502A, and the outer layer 504 is formed with a cut-in 504A. In order to peel a peeling portion 506, when the peeling portion 506 is turned over outwardly from the cut-in 504A toward the cut-in 502A, the peeling portion 506 is peeled off the dry laminate layer 503 for the connecting the layers to each other and completely removed from the remaining portion of the wrapper 500 through the cut-in 502A.

In FIGS. 14 through 16 numeral 9 indicates a main body of the film unit with lens.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A photographic film unit comprising a body containing unexposed photographic film, said body having a horizontal length and a vertical height and a horizontal depth that extends from front to rear of said body, said length being greater than either said height or said depth, a taking lens in the body for exposing the photographic film, a viewfinder to determine the field of view of the photographic film unit, a shutter release button in said body for causing an exposure of the photographic film through said taking lens, a wrapper within which said body is enclosed, said wrapper having a portion covering at least a part of said body of the film unit, said portion being adapted to be peeled away from a remaining portion of said wrapper by which said body remains partially enclosed after said peelable portion is peeled away, said peelable portion when peeled away exposing said taking lens and said viewfinder and said shutter release button, and said wrapper extending endwise beyond the body in prolongation of said horizontal length and having walls thereof sealed together, and a hole passing through said sealed-together walls for hanging said unit at a point of sale, said walls being sealed together entirely about said hole.

2. A photographic film unit as claimed in claim 1, and a loop of flexible material threaded through said hole and encircling a portion of said endwise extending wrapper.

3. A photographic film unit as claimed in claim 2, said hole being disposed to the left of the body as viewed by a user holding the unit.

4. A photographic film unit as claimed in claim 1, said body having also a flash emission window in a front portion of said body and a switch for charging a flash disposed behind said window, said peelable portion when peeled away exposing also said window and said switch.

5. A photographic film unit as claimed in claim 1, said body also having a film counter window in a top portion of said body, said peelable portion when peeled away exposing also said film counter window.

6. A photographic film unit as claimed in claim 4, a rear portion of said body having a window know extending therethrough, said winding knob being also exposed when said peelable portion is peeled away.

7. A photographic film unit as claimed in claim 1, there being a line of weakness surrounding said peelable portion whereby said peelable portion is readily torn from the remainder of the wrapper.

8. A photograph film unit as claimed in claim 1, the portion of the wrapper that extends endwise beyond the body lying entirely outside of said peelable portion.

9. A photographic film unit as claimed in claim 1, said body having opposite ends at the ends of said horizontal length, said peelable portion being spaced entirely lengthwise inwardly between said ends of the body.

10. A photographic film unit as claimed in claim 8, said peelable portion extending about no more than three sides of said body.

11. A photographic film unit comprising a body containing unexposed photographic film, a taking lens in the body for exposing the photographic film, a viewfinder to determine the field of view of the photographic film unit, a shutter release button in said body for causing an exposure of the photographic film through said taking lens, a wrapper within which said body is enclosed, said wrapper having a portion covering at least a part of said body of the film unit, said portion being adapted to be peeled away from a remaining portion of said wrapper by which said body remains partially enclosed after said peelable portion is peeled away, said peelable portion when peeled away exposing said taking lens and said viewfinder and said shutter release button, and said wrapper extending endwise beyond the body and having walls thereof sealed together, and a hole passing through said sealed-together walls for hanging said unit at a point of sale, said walls being sealed together entirely about said hole, there being at least one line of pressure-sensitive adhesive by which line of pressure-sensitive adhesive said peelable portion is releasably held on the remainder of the wrapper.

* * * * *